US009159489B2

(12) United States Patent
Hwang et al.

(10) Patent No.: US 9,159,489 B2
(45) Date of Patent: Oct. 13, 2015

(54) METHOD OF PRODUCING POWDER MAGNETIC CORE AND METHOD OF PRODUCING MAGNETIC CORE POWDER

(75) Inventors: Junghwan Hwang, Nisshin (JP); Takeshi Hattori, Nagakute (JP); Masaki Hirano, Tsushima (JP); Masaki Sugiyama, Miyoshi (JP); Yusuke Oishi, Nagoya (JP); Daisuke Okamoto, Miyoshi (JP); Hidenari Yamamoto, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 253 days.

(21) Appl. No.: 13/811,489

(22) PCT Filed: Jul. 20, 2011

(86) PCT No.: PCT/IB2011/001697
§ 371 (c)(1),
(2), (4) Date: Feb. 21, 2013

(87) PCT Pub. No.: WO2012/010958
PCT Pub. Date: Jan. 26, 2012

(65) Prior Publication Data

US 2013/0147081 A1 Jun. 13, 2013

(30) Foreign Application Priority Data

Jul. 23, 2010 (JP) ..... 2010-166396

(51) Int. Cl.

| | |
|---|---|
| ***H01F 41/02*** | (2006.01) |
| ***H01F 27/255*** | (2006.01) |
| ***B22F 1/00*** | (2006.01) |
| ***H01F 1/26*** | (2006.01) |

(52) U.S. Cl.
CPC ..... *H01F 41/0246* (2013.01); *B22F 1/0077* (2013.01); *H01F 1/26* (2013.01); *H01F 27/255* (2013.01); *H01F 41/0266* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 4,981,635 | A * | 1/1991 | Yamashita et al. | 264/112 |
| 6,190,589 | B1 * | 2/2001 | Bryant et al. | 264/128 |
| 6,224,798 | B1 * | 5/2001 | Gay | 264/102 |
| 6,342,557 | B1 * | 1/2002 | Suzuki et al. | 524/432 |
| 6,365,078 | B1 * | 4/2002 | Yamashita et al. | 264/122 |
| 2003/0001718 | A1 | 1/2003 | Inoue et al. | |
| 2005/0081961 | A1 * | 4/2005 | Yamashita | 148/301 |
| 2005/0265883 | A1 * | 12/2005 | Ishii et al. | 419/10 |
| 2007/0243400 | A1 * | 10/2007 | Miyahara et al. | 428/546 |
| 2007/0269332 | A1 * | 11/2007 | Miyahara et al. | 419/23 |
| 2008/0298995 | A1 * | 12/2008 | Nakamura | 419/10 |
| 2009/0121175 | A1 * | 5/2009 | Maeda et al. | 252/62.51 R |
| 2010/0079015 | A1 | 4/2010 | Hoshina et al. | |
| 2010/0237978 | A1 * | 9/2010 | Brunner et al. | 336/233 |
| 2011/0024670 | A1 | 2/2011 | Otsuki et al. | |
| 2011/0068506 | A1 | 3/2011 | Kusawake et al. | |

FOREIGN PATENT DOCUMENTS

| | | | |
|---|---|---|---|
| CN | 1875439 | A | 12/2006 |
| EP | 1 679 725 | A1 | 7/2006 |
| EP | 1 679 726 | A1 | 7/2006 |
| EP | 2 359 963 | A1 | 8/2011 |
| JP | 60-194509 | A | 10/1985 |
| JP | 09-223618 | A | 8/1997 |
| JP | 2002-144328 | A | 5/2002 |
| JP | 2002305108 | A | 10/2002 |
| JP | 2006128521 | A | 5/2006 |
| JP | 2007-116093 | A | 5/2007 |
| JP | 2008-270539 | A | 11/2008 |
| JP | 2008-303443 | A | 12/2008 |
| JP | 2009-259939 | A | 11/2009 |
| JP | 20101561 | A | 1/2010 |
| WO | 2009/128425 | A1 | 10/2009 |
| WO | 2010/061525 | A1 | 6/2010 |

OTHER PUBLICATIONS

International Search Report for corresponding International Patent Application No. PCT/IB2011/001697 mailed Jan. 26, 2012.

* cited by examiner

*Primary Examiner* — Mary F Theisen
(74) *Attorney, Agent, or Firm* — Sughrue Mion, PLLC

(57) ABSTRACT

The invention includes: powder preparation step of obtaining magnetic core powders by mixing, of magnetic powders with thermosetting resin powders in hot state; powder filling step of filling the obtained magnetic core powders into a die; a compaction step of compacting magnetic core powders; and compact heating step of heating, compacts to the elevated temperature state at which the thermosetting resin hardens after compaction.

5 Claims, 4 Drawing Sheets

(NORMAL)

METHOD OF PRODUCING POWDER MAGNETIC CORE AND METHOD OF PRODUCING MAGNETIC CORE POWDER

BACKGROUND OF THE INVENTION

1. Field of the Invention

The invention relates to a method of producing a powder magnetic core and to a method of producing a magnetic core powder therefor.

2. Description of Related Art

There are many articles that electromagnetism, e.g., transformers, motors, generators, reactors, speakers, induction heaters, various actuators, and so forth, in our surroundings. For example, the stator core and the rotor core in a motor and the reactor core in a reactor are mostly made from powder magnetic cores made by the compacting of resin-coated soft magnetic powders. Due to this application of a resin film to the particle surfaces, such a soft magnetic metal powder for powder magnetic core fabrication suppresses the appearance of iron losses by establishing insulation for the powder and hence insulation for the powder magnetic core itself.

The methods used to coat magnetic powders can generally be divided into wet methods and dry methods. For example, Japanese Patent Application Publication No. 2008-303443 (JP-A-2008-303443) discloses the production of a powder magnetic core by bringing a soft magnetic powder into contact with a coating treatment solution prepared by dissolving a silicone resin in methanol; thereafter drying the soft magnetic powder to form a silicone resin film on the particle surfaces; and subsequently compacting the soft magnetic powder to form a powder magnetic core. This wet method, which employs a solvent to form a silicone resin film, can form a uniform silicone resin film on the surfaces of the magnetic particles. However, it requires a step of drying off the solvent and also requires the disposition of a vacuum device for degassing and thus inevitably entails increased costs from both a process standpoint and an equipment standpoint. The execution of a continuous magnetic powder coating process is also problematic.

In order to avoid the problems described above for wet methods, attention has focused on powder magnetic core production methods that utilize a dry process that does not employ a solvent. Japanese Patent Application Publication No. 2008-270539 (JP-A-2008-270539) and Japanese Patent Application Publication No. 2009-259939 (JP-A-2009-259939) disclose powder magnetic core production methods including a mixing step, in which a resin powder formed from a thermosetting silicone resin is mixed with a magnetic powder having an insulating film, e.g., a silica film, on the particle surface; a compacting step, in which the mixed powder provided by the mixing step is compacted in hot state; and a heating step, in which the compact provided by the compacting step is heated to a high temperature state at which the silicone resin cures. In addition, the compacting step includes a heating step, in which the mixed powder filled into a die is heated to bring it into hot state; and a compression step, in which the mixed powder, while residing in a state in which the resin powder has been softened due to the heating step, is compacted. This hot state denotes a high temperature environment in which the resin powder does not undergo a complete condensation polymerization. In this Specification, "hot compacting" refers to a method of obtaining a compact via a compacting step in which compacting is performed in hot state temperature environment.

The methods disclosed in JP-A-2008-270539 and JP-A-2009-259939 can produce a powder magnetic core without using a solvent. However, these methods, by their very nature, include just the compacting of a mixture of a resin powder and a soft magnetic powder that has been insulated with a silica film. As a consequence, the role of the resin in the powder magnetic core resides more in strengthening the powder magnetic core through particle-to-particle bonding than in the insulation of the soft magnetic powder. Accordingly, when use is made of a soft magnetic powder that has not been insulated with, e.g., a silica film, it is thought that, for example, large losses will occur without the ability to obtain a thorough coating of the particle surfaces by the resin, and the magnetic properties will decline.

Moreover, a powder magnetic core is fabricated in each of the examples given in JP-A-2008-270539 and JP-A-2009-259939 using not more than 0.3 mass % resin powder with reference to the mixed powder as a whole. It is stated in JP-A-2008-270539 that when the resin powder is incorporated at 0.2 mass %, the compact provided by compacting in hot state can be removed from the die using a low decompacting pressure without producing, for example, galling with the die. The inventors have in fact confirmed that a powder magnetic core having the desired magnetic properties and strength and also free of problems with its appearance is obtained when the resin powder is incorporated at 0.2 mass %.

However, it was also discovered that a powder magnetic core having a normal appearance is not obtained when the same procedure as described in JP-A-2008-270539 or JP-A-2009-259939 is used to produce a powder magnetic core that has a relatively large resin powder content, as is used, for example, in reactor cores. The abnormalities in appearance included, for example, roughening and cracking of the surface of the powder magnetic core, chipping at angles of the powder magnetic core, and lamination. These abnormalities in appearance pose a number of risks; for example, they can lead to breakage, they can prevent use due to their effect on the dimensional accuracy, and, even when they do not have a direct influence on the magnetic properties, they can lower the reliability.

It was further discovered that the filling behavior by the mixed powder is impaired when a mixed powder containing relatively large amounts of resin powder is filled into a die that has been preheated to hot state; for example, the particles may aggregate or coalesce with one another and the resin powder may melt bond to the surface of the die. This impaired filling behavior is thought to be connected to the impaired compacting behavior noted above.

SUMMARY OF THE INVENTION

The invention provides a method of producing a powder magnetic core that uses a magnetic core powder that provides an excellent coating behavior by the resin on the magnetic powder and that exhibits an excellent filling behavior and an excellent compacting behavior. The invention also provides a method of producing a magnetic core powder.

The first aspect of the invention relates to a method of producing a powder magnetic core, including: obtaining magnetic core powders by mixing magnetic powders with thermosetting resin powders in hot state; filling the obtained magnetic core powder into a die; compacting the filled magnetic core powder to obtain a compact; and heating the obtained compact into a state in which the thermosetting resin hardens.

According to this structure, the magnetic powder and resin powder are not subjected to simple mixing, but rather are mixed in hot state, and as a consequence the resin powder, which has become uniformly mixed with the magnetic powder, is softened and flows at the surface of the particles of the magnetic core powder. This results in the formation of a resin film on the surface of the particles of the magnetic core powder.

In addition, the aforementioned structure makes possible the execution of powder magnetic core compacting on a continuous basis. This is made possible because the die contamination caused by adherence of the resin to the die is inhibited in the powder filling step and compacting step, which eliminates the need to clean the die or change out the die with each compacting. Furthermore, pretreatment of the magnetic core powder and/or the conditions employed in the powder production step make possible the production of a powder magnetic core that has excellent values for the desired properties, for example, the strength and magnetic properties such as the magnetic permeability.

The second aspect of the invention relates to a method of producing a magnetic core powder, this method including: obtaining magnetic core powders by mixing, in hot state, of magnetic powders with thermosetting resin powders. This structure makes possible the production of a magnetic core powder that is very suitable for use in the powder magnetic core production method according to the above-described first aspect.

Using the powder magnetic core production method of the invention and the magnetic core powder production method of the invention, a magnetic core powder that presents an excellent coating performance by the resin is obtained; moreover, this magnetic core powder exhibits an excellent filling behavior and an excellent compacting behavior.

BRIEF DESCRIPTION OF THE DRAWINGS

The foregoing and further objects, features, and advantages of the invention will become apparent from the following description of example embodiments with reference to the accompanying drawings, wherein like numerals are used to represent like elements and wherein.

DETAILED DESCRIPTION OF EMBODIMENTS

Figure 1:
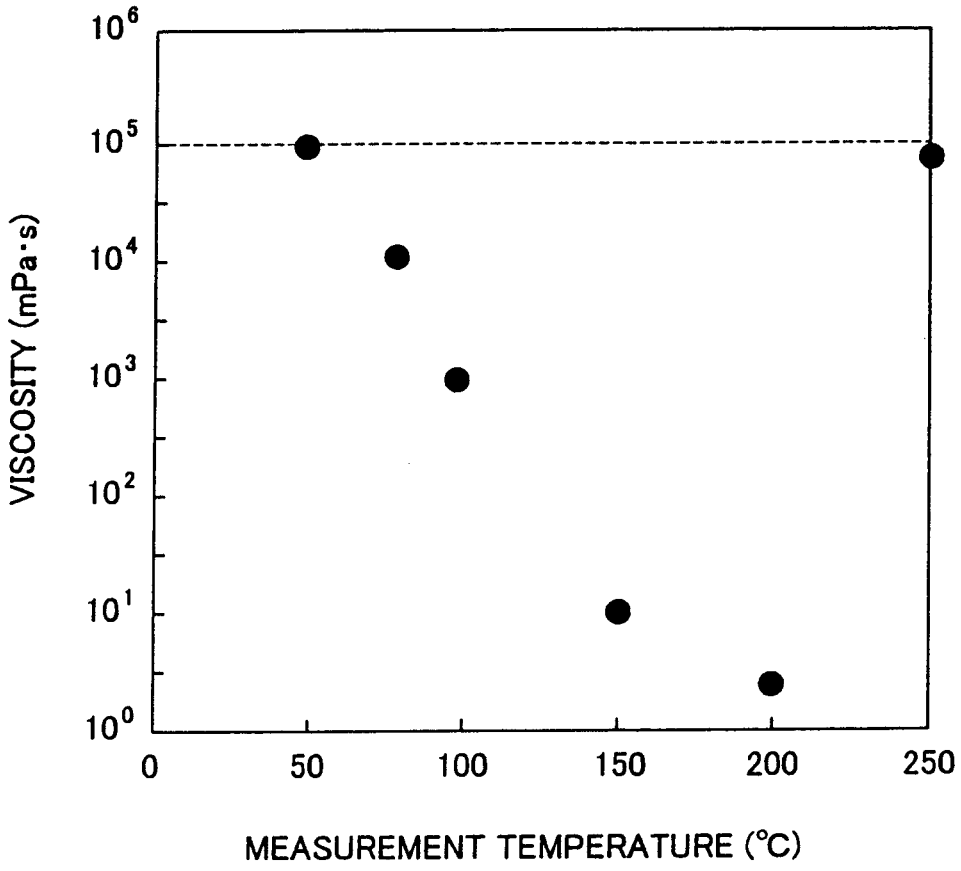
FIG. 1 is a graph of the silicone resin viscosity-versus-temperature relationship when the temperature of the silicone resin used in the examples is raised.

Embodiments of the invention are described herebelow. Unless specifically stated otherwise, a numerical range in this Specification styled as "x to y" includes the lower limit x and the upper limit y in the range. In addition, a numerical value range may be constructed within this numerical value range by any combination of numerical values given in this Specification.

A powder magnetic core production method according to an embodiment of the invention includes principally a powder production step, a powder filling step, a compacting step, and a compact heating step. The magnetic core powder production method according to the invention corresponds to the powder production step. The starting powders used and the individual steps are described below.

The Raw Powders

The composition of the magnetic powder is not particularly limited, but may include a magnetic powder in which the main component is a strongly magnetic element, e.g., a Group 8 transition element such as Fe, Co, and Ni. The magnetic powder may in particular be a soft magnetic powder in which the main component is Fe, and, for example, a pure iron powder or Fe—Si powder is favorably used. The presence of Si raises the electrical resistivity of the powder particles, raises the specific resistance of the powder magnetic core, and lowers the eddy current loss. In addition, when a silicone resin powder is used for the resin powder, the presence of Si is desirable for improving the bondability between the magnetic core powder and the resin acting as the binder.

In the case of Fe—Si powder, and assigning 100 mass % to the powder as a whole, it suitably contains 0.5 to 3 mass % Si with the balance being Fe, a modifying element, and/or unavoidable impurities. This "modifying element" is an element effective for improving the properties of the powder magnetic core, e.g., the magnetic properties, electrical properties, mechanical properties, and so forth. The type of property that is improved is not restricted, nor is the type of element or the element combination. Other than Si, such elements can be exemplified by Al, Ni, and Co. The "unavoidable impurities" refers, for example, to impurities present in the starting material, such as the melt, for the Fe—Si powder and to impurities that are introduced during powder formation, and are elements that are difficult to remove for cost or technical reasons. Examples in the case of Fe—Si powder are C, S, Cr, P, Mn, and so forth. The content of these modifying elements and unavoidable impurities is generally brought to a relatively low level that will not bring about a reduction in the magnetic properties.

The magnetic powder may be a mixed powder provided by mixing different magnetic-powders each other. For example, the magnetic powder may a mixed ferrous powder of pure iron powder with Fe-49 mass % Co-2 mass % V (permendur) powder, pure iron powder with Fe-3 mass % Si powder, or pure iron powder with Sendust (Fe-9 mass % Si-6 mass % Al).

In order to lower the loss of the powder magnetic core, the particle size of the magnetic powder is suitably 20 to 300 μm, more suitably 45 to 250 μm, and even more suitably 80 to 150 μm. It is difficult to pursue lower eddy current losses at overly large particle sizes for the magnetic powder, while it is difficult to pursue lower hysteresis losses at overly small particle sizes. Classification of the magnetic powder can be readily performed by, for example, sieving.

There are no limitations on the method of producing the above-described magnetic powder, and the magnetic powder may be a ground powder or an atomized powder. Among atomized powders, water-atomized powders currently have the best availability and are low cost. The magnetic powder may of course be a powder other than an atomized powder; for example, it may be a ground powder provided by grinding an alloy ingot with, for example, a ball mill. Such a ground powder may be used after its crystal grain size has been increased by a heat treatment, for example, heating at 800° C. or above in an inert atmosphere. In addition, a hydrogen reduction treatment, which is a typical pretreatment, may be executed on a ferrous magnetic powder.

The resin powder is formed from a thermosetting resin. This thermosetting resin, is a resin of the type that condenses and cures under the application of heat. Under the application of heat, crosslinking develops due to functional group reactions, producing condensation and curing. Due to the use in this embodiment of a resin powder that is a particulate, i.e., a solid, at ambient temperature, softening (gelation) initially occurs accompanying a temperature rise due to the application of heat, followed by condensation and curing in a higher temperature region.

The thermosetting resin functions as an insulating film that coats the surface of the constituent particles, and, in the powder magnetic core, functions to insulate the constituent particles and also functions as a strong binder that binds the constituent particles. A thermosetting silicone resin is desirably used as the resin powder. In the case of a thermosetting silicone resin, softening (gelation) initially occurs when the initial softening temperature is exceeded, and, when the initial condensation temperature is exceeded, a partial crosslinking occurs as siloxane bonding develops accompanying the increase in temperature and the softening recedes. In addition, the partial crosslinking is converted to complete crosslinking at and above the initial curing temperature and the silicone resin then becomes strongly hardened. The initial softening temperature, initial condensation temperature, and initial hardening temperature of the silicone resin powder used in this embodiment cannot be rigorously specified due to the differences among the types of silicone resins. However, ordinary silicone resins begin to soften at around 70 to 130° C., and silicone resin condensation begins at about 70 to 130° C. higher than the temperature at which softening starts.

The number of functional groups in the silane compound in the silicone resin is from 1 to a maximum of 4. There is no limitation on the number of functional groups in the silicone resin used in this embodiment. However, a desirably high crosslinking density occurs with the use of a silicone resin that has a trifunctional or tetrafunctional silane compound.

The silicone resin powder used in this embodiment can be specifically exemplified by methyl-type thermosetting silicone resin powders such as YR3370 (initial softening temperature: 70° C., initial condensation temperature: 200° C.) from Momentive Performance Materials Inc., and by KR220L (initial softening temperature: 70° C., initial condensation temperature: 140° C.) from Shin-Etsu Chemical Co., Ltd. Moreover, the embodiments of the invention may use a silicone resin provided by mixing, in suitable proportions, two or more silicone resins that differ with regard to type, molecular weight, and/or functional group.

In a powder production step described later, Assigning 100 mass % to the mixed powder including the magnetic powder and the resin powder as a whole, the mixing proportion for the resin powder may be from 0.1 mass % to 3 mass % and more particularly 0.4 to 1 mass %. This mixing proportion for the resin powder approximately agrees with the resin content when the magnetic core powder as a whole is taken to be 100 mass % and also approximately agrees with the content of the resin functioning as a binder when the powder magnetic core is taken to be 100 mass %.

The Powder Production Step

The powder production step is a step of obtaining a magnetic core powder by the mixing in hot state of the previously described magnetic powder and resin powder. As described above, a resin film is formed on the particle surfaces of the magnetic core powder by this hot state mixing of the magnetic powder and resin powder.

A mixer that is generally used for powder mixing, e.g., a heated kneader, may be used to mix the magnetic powder and resin powder. The stirring rate may be adjusted in conformity to the type and capacity of the mixer and the total amount of the mixed powder, wherein the range of 1 to 1000 rpm is desirable. The mixing time in the hot state is desirably 1 to 120 minutes.

Figure 2:
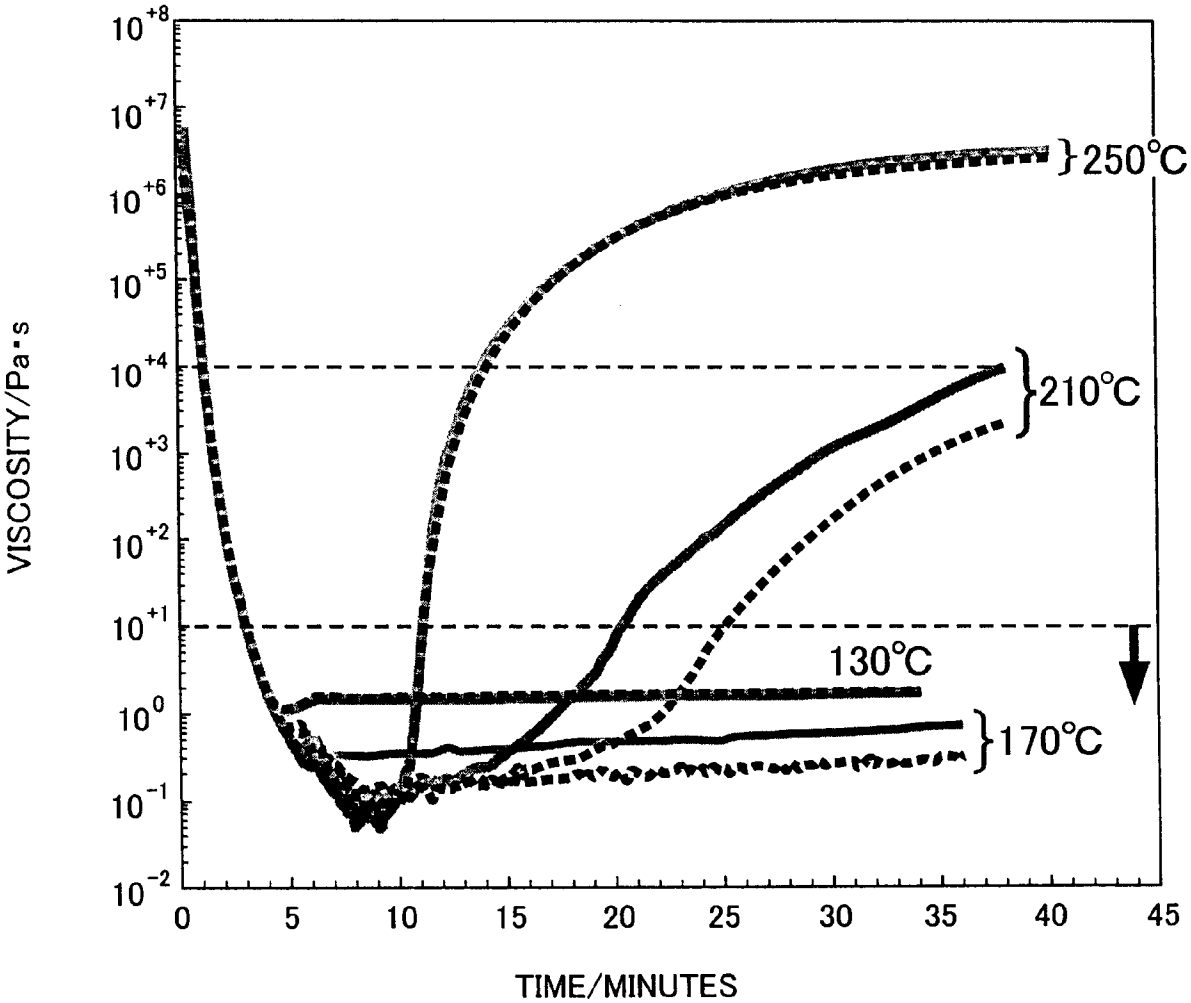
FIG. 2 is a graph of the silicone resin viscosity-versus-holding time relationship when the silicone resin used in the examples is held at various temperatures.

The temperature when the magnetic powder and resin powder are mixed is a temperature at which the resin powder is softened and specifically is greater than or equal to the initial softening temperature of the thermosetting resin. The powder production step requires only that the resin powder undergo softening; however, viewed from the standpoint of a uniform coating by the resin powder of the particle surfaces in the magnetic core powder, the mixed powder is favorably mixed at a temperature that brings the viscosity of the thermosetting resin to not more than 10,000 Pa·s, particularly not more than 1,000 Pa·s, more particularly not more than 100 Pa·s, and more especially particularly not more than 10 Pa·s. This is because the thermosetting resin flows more easily over the particle surface as the viscosity declines, resulting in a uniform coating of the particle surfaces of the magnetic core powder. FIG. 1 is a graph that shows the results of measurement of the viscosity of the silicone resin (KR220L) used in the examples described below, while the temperature of this silicone resin was raised by heating. The viscosity was measured by a dynamic viscoelastic method using an MR-300 Soliquid Meter from the Rheology Co., Ltd. The rate of temperature rise in the measurements was 2° C./minute. The thermosetting resin, which is a particulate (solid) at ambient temperature, softens at the initial softening temperature and above, and, due to the lower viscosity accompanying the rise in temperature, readily converts into a uniform film. Thus, it can be said with regard to the temperature for mixing the magnetic powder with the resin powder that a higher temperature is more favorable as long as the initial hardening temperature of the thermosetting resin is not exceeded. For example, with KR220L, the viscosity starts to decline at 70° C.; when the temperature is raised further as shown in FIG. 1, partial condensation begins at about 140° C. and the extent of the viscosity decline becomes smaller as the temperature increases; and at above 200° C. softening is complete and hardening begins and the viscosity assumes a sharply rising course. In addition, FIG. 2 is a graph that shows the results of measurements over time of the viscosity of KR220L held at a prescribed temperature by heating. The viscosity was measured by a dynamic viscoelastic method using the above-described ARES-G2 Rheometer from TA Instruments, Inc. The temperature was raised at 20° C./minute until the prescribed holding temperature was reached. The horizontal axis in the graph is the time after the KR220L reached the prescribed holding temperature. The measurements were performed a plurality of times at each temperature, and duplicate runs are shown in the graph from among each set of runs. The viscosity reached a softening-induced minimum at around 5 minutes when the KR220L was held at 130° C. and at around 10 minutes when held at 170° C. There was almost no increase in viscosity after this even though standing at a constant temperature was continued. When the KR220L was held at 210° C. or 250° C., the softening-induced viscosity again reached a minimum at around 10 minutes, but subsequent to this the viscosity rose when holding at a constant temperature was continued. In particular, the viscosity of the KR220L held at 250° C. underwent a sharp increase and quickly exceeded $10^4$ Pa·s. Accordingly, when a favorable range for mixing the magnetic powder with the resin powder is indicated—using the initial softening temperature of the thermosetting resin as the standard—in terms of from at least (the initial softening temperature+a° C.) to not more than (the initial softening temperature+b° C.), a may be 10 and more particularly 30 and b may be 130, 100 and more particularly 80. When the mixing temperature is in the aforementioned range, the magnetic powder and resin powder are easily mixed to uniformity and as a result a magnetic core powder is readily obtained in which the magnetic powder is uniformly coated with a resin film.

In addition, when considered in relation to the compacting temperature in the compacting step, infra, mixing of the mixture of the magnetic powder and resin powder is favorably done at or above the compacting temperature. This is because causing softening of the thermosetting resin at or above the compacting temperature suppresses softening of the resin in the filling step and thereby improves the filling behavior.

Viewed from the perspective of uniformly coating the surfaces of the particles in the magnetic core powder, the particle size of the resin powder may be, for example, 0.01 to 350 μm.

The softened thermosetting resin is re-solidified by cooling the mixture of the magnetic powder and resin powder after heating. Doing this yields a magnetic core powder in which the particle surfaces of the magnetic powder are coated with the thermosetting resin. When lumps are present after cooling, the powder can be produced by gentle deagglomeration using, for example, a mortar. A magnetic core powder in which the particle surfaces in the magnetic powder are coated with the resin is obtained simply by agitating while cooling.

The Powder Filling Step

The powder filling step is a step of filling the magnetic core powder into an ambient temperature die or a preheated die. Prior to the compacting step, infra, the die may be preheated to hot state. Specifically, preheating is favorably carried out to at least the initial softening temperature of the thermosetting resin but to below the initial curing temperature of the thermosetting resin, i.e., to about the compacting temperature in the compacting step.

A lubricant may be coated on the interior surface of the die during the preheating process. This lubricant may be the usual lubricants heretofore used in the compacting of compacts. The method of applying the lubricant may be selected as appropriate in conformity to the type of lubricant. Application of the lubricant may be carried out at ambient temperature or on the preheated die, but in the case of a continuous compacting operation a lubricant must be used that is capable of use at elevated temperatures.

The Compacting Step

The compacting step is a step of compacting the magnetic core powder at ambient temperature or in hot state. The compacting step yields a compact. Compacting may be starting directly after filling the magnetic core powder into the die or may be started when the magnetic core powder has reached the compacting temperature. A high-density compact having a high magnetic flux density is obtained by compacting the compact by a hot compacting procedure in which compacting is performed in hot state. The compacting step may be performed in a magnetic field or in the absence of a magnetic field.

A specific example of a hot compacting procedure is a lubricated-die hot high-pressure compacting procedure capable of ultrahigh-pressure compacting. This lubricated-die hot high-pressure compacting procedure includes a filling step of filling the previously described magnetic core powder into a die whose inner surface has been coated with a higher fatty acid-type lubricant, and a hot high-pressure compacting step of compacting at a compacting temperature and compacting pressure that produce a metal soap film between the magnetic core powder and the inner surface of the die apart from the higher fatty acid-type lubricant. The details of this lubricated-die hot high-pressure compacting procedure have been described in a number of publications, for example, Japanese Patent No. 3309970 and Japanese Patent No. 4024705. This lubricated-die hot high-pressure compacting procedure makes it possible to easily obtain a high-density compact while extending the life of the die.

The inherent meaning of the "hot" in the lubricated-die hot high-pressure compacting procedure differs from that of the "hot" for bringing about softening of the thermosetting resin. In the former case the objective is to produce a metal soap film apart from the higher fatty acid-type lubricant. In the latter case the objective is to bring about a softening of the thermosetting resin, and the latter case is specifically greater than or equal to the initial softening temperature of the thermosetting resin and less than the initial hardening temperature of the thermosetting resin. A high-density, high-strength powder magnetic core can then be efficiently produced by having these two "hot" states occur in common. When a silicone resin powder is used, the hot state is then suitably at least 80° C. but not more than 200° C. and is more suitably 100 to 150° C.

The compacting step does not necessarily require the use of a lubricant or compacting at high pressures such as in excess of 100 MPa, and the type of lubricant, the quantity of lubricant use, whether or not a lubricant is used, and the compacting pressure may be varied in conformity to the properties desired for the powder magnetic core. For example, when the proportion of resin incorporation in the magnetic core powder is 0.1 mass % or more, the compacting pressure may be 686 MPa to 1960 MPa and in particular may be 180 MPa to 1568 MPa.

The Compact Heating Step

The compact heating step is a step, following the compacting step, of heating the compact under elevated temperature conditions at which the thermosetting resin hardens. The thermosetting resin coating the particle surfaces of the magnetic core powder in the compact binds the particles of the magnetic core powder to each other accompanying the increase in temperature due to heating. In addition, when the elevated temperature condition is reached, the thermosetting resin filled between the particles of the magnetic core powder undergo thermosetting by a condensation polymerization reaction, thus tightly bonding the individual particles of the magnetic core powder. A high-strength powder magnetic core is obtained as a result. The heating temperature (at least 300° C. when a silicone resin powder is used), heating time, and heating atmosphere are not restricted as long as ranges are used in which this thermosetting of the thermosetting resin proceeds.

In addition, in order to lower the coercive force and hysteresis loss of the powder magnetic core, the compact may be annealed in order to eliminate the residual strain and residual stress in the compact. The previously described heating step may do double duty as an annealing step. The heating temperature for this, while also depending on the composition of the magnetic core powder, is about 400 to 800° C. The heating time may be 0.2 to 3 hours and more particularly may be about 0.5 to 1.0 hour. Because the annealing step involves heating at a relatively high temperature, the atmosphere therefor may be an inert atmosphere.

Some degeneration of the thermosetting resin can occur when the softened thermosetting resin is heated at an elevated temperature above its heat resistance temperature. However, since silicone resins have a high heat resistance, a sharp decline in the specific resistance of the powder magnetic core will be rare.

The Coupling Layer Formation Step

The steps according to the method of this embodiment for producing a powder magnetic core have been described above, but a coupling layer formed of a silane coupling agent may be formed on the particle surfaces in the magnetic powder provided to the powder production step. When the particle surfaces of a magnetic powder are to be coated with a resin material such as a silicone resin, a coupling layer formed of a silane coupling agent may be formed interposed between the two with the goal of generating adherence by improving the wettability between the resin material and the particles. This is effective in particular when a silicon-containing magnetic powder and a silicone resin are used.

The coupling layer formation step favorably includes a contact step, in which the silane coupling agent is brought into contact with the surfaces of the particles in the magnetic powder, and optionally a drying step following the contact step, in which the magnetic powder is dried. The drying step may be omitted, but in order to improve the strength of the resulting powder magnetic core, drying is favorably carried out by heating to at least 50° C., particularly 60 to 90° C., and more particularly 75 to 85° C.

The coupling agent can be exemplified by KBM-303, KBM-403, KBE-402, KBE-403, KBM-602, KBM-603, KBM-903, and KBE-903 (Shin-Etsu Chemical Co., Ltd.). A coupling layer can be readily formed on the surface of the magnetic core powder by treating the magnetic powder with a solution prepared by dissolving or dispersing such a silane coupling agent in a solvent. Water and organic solvents can be used as the solvent. Taking the magnetic core powder as whole to be 100 mass %, the coupling agent is favorably adjusted to be from 0.01 to 0.5 mass % and particularly from 0.03 to 0.3 mass %. When an Si-containing magnetic powder and a silicone resin are used, a satisfactory wettability is displayed even at a very small blending proportion for the silane coupling agent.

According to investigations by the inventors to date, an even higher strength powder magnetic core is obtained when a strongly basic silane coupling agent, e.g., an amino group-functional silane coupling agent, is used. This is thought to occur because the amino group-functional silane coupling agent acts as a catalyst, resulting in a promotion of silicone resin harden.

Other Steps

In addition to the individual steps described in the preceding, the method of this embodiment for producing a powder magnetic core may include other steps as necessary.

For example, the method of this embodiment for producing a powder magnetic core may additionally have, prior to the previously described powder production step, a powder mixing step in which the magnetic powder and resin powder are mixed at less than the initial softening temperature of the thermosetting resin. The temperature in this powder mixing step is desirably a temperature at which the resin powder does not soften, i.e., not more than 50° C., and the powder mixing step is favorably carried out at room temperature. Mixing may be carried out using a mixing device as generally used for mixing powders, e.g., a V-mixer. A magnetic core powder in which the magnetic powder is uniformly covered with a resin coating is readily obtained in the ensuing powder production step due to the uniform mixing of the magnetic powder and resin powder provided by premixing the magnetic powder and resin powder at a temperature at which the resin powder is not softened. After the powder mixing step, the same mixing may be continued and the temperature may be gradually raised to transition into the powder production step, or the mixed powder may be introduced into a mixer that has been brought to the prescribed temperature in order to start the powder production step.

In addition, those steps generally performed in the production of powder magnetic cores may also be implemented, such as a hydrogen reduction treatment step, which, as noted above, is a general pretreatment that is performed on ferrous soft magnetic powders.

The Powder Magnetic Core

The method of powder magnetic core production of this embodiment provides a powder magnetic core formed of a magnetic powder and a resin fraction (binder) that holds the magnetic powder while insulating the particles from one another. The effects of this embodiment on the filling behavior and compacting behavior are very prominently manifested when a powder magnetic core is produced in which the amount of resin functioning as a binder exceeds 0.3 mass %.

Embodiments of the powder magnetic core production method and magnetic core powder production method of the invention have been described in the preceding, but the embodiments of the invention are not limited to the embodiments described above.

Examples are specifically described below of the powder magnetic core production method and magnetic core powder production method of the invention. The magnetic core powders were produced by a dry method in the examples and comparative examples described herebelow and by a wet method in the reference examples.

Magnetic Core Powder Production

A commercial atomized powder having the composition Fe-3 mass % Si was prepped as the soft magnetic powder. This powder was classified to −80 mesh, and the resulting powder containing particles less than 180 μm was used. After classification, a hydrogen reduction treatment was performed on the soft magnetic powder at 900 to 950° C.

Example 1

Powder magnetic cores were produced by the following procedure.

The Powder Production Step

A mixed powder was obtained by mixing the following: the soft magnetic powder that had been subjected to the hydrogen reduction treatment, a silicone resin powder (KR220L from Shin-Etsu Chemical Co., Ltd., solid powder with a particle size not more than 10 μm, initial softening temperature: 70° C., initial condensation temperature: 140° C.). The amount of incorporation of the silicone resin powder was 0.5 mass % with reference to the mixed powder as a whole. This mixed powder was mixed by stirring with a glass rod in a container for 5 minutes at the prescribed temperature. The temperature of the mixed powder during mixing was 130° C. in Example 1-1, 150° C. in Example 1-2, and 170° C. in Example 1-3. This was followed by continuing to stir in the same manner while cooling to room temperature, thereby providing a magnetic core powder.

The Filling Step

A die made by cemented carbide was prepared; this die had a cavity that corresponded to the shape of the test specimen. The TiN coating treatment had been performed on the inner circumference of the die, and its surface roughness was 0.4 Z. The die was initially preheated with a band heater so as to bring the temperature within the cavity to 130° C.

Lithium stearate dispersed at 1% in an aqueous solution was uniformly coated using a spray gun on the interior circumference of the heated die at a rate of about 10 $cm^3$/minute. The aqueous solution used here was prepared by adding surfactant and an antifoam to water. Polyoxyethylene (6EO) nonylphenyl ether, polyoxyethylene (10EO) nonylphenyl ether, and the borate ester Emulbon T-80 were used for the surfactant, and 1 volume % of each was added with reference to the aqueous solution as a whole (100 volume %). FS Antifoam 80 was used for the antifoam and was added at 0.2 volume % with reference to the aqueous solution as a whole (100 volume %). The lithium stearate used had a melting point of approximately 225° C. and a particle size of 20 μm. It was dispersed at 25 g per 100 $cm^3$ of the aforementioned aqueous solution. In addition, this was additionally subjected to a microfine-sizing treatment (Teflon-coated steel spheres: 100 hours) using a ball mill-type grinder, and the obtained stock solution was diluted by 20 times to make an aqueous solution with a final concentration of 1%, which was provided to the previously described coating process.

The magnetic core powder obtained in the powder production step is filled to this cavity.

The Compacting Step

The mixed powder was compacted at 1568 MPa while continuing to hold the temperature in the magnetic core powder-filled cavity at the hot state of 130° C. This provided a ring-shaped compact with an outer diameter 39 mmϕ×inner diameter 30 mmϕ×thickness 5 mm.

The Compact Heating Step

Using a variable atmosphere sintering furnace, this compact was subjected to a heat treatment for 1 hour at 750° C. in a nitrogen atmosphere at a flow rate of 8 L/minute, thereby yielding a powder magnetic core.

Example 2

Powder magnetic cores were fabricated as in Example 1, but carrying out the contact step described below on the soft magnetic powder after the hydrogen reduction treatment.

The Contact Step

The soft magnetic powder was mixed with an aqueous solution of an amino group-functional silane coupling agent (S-330 from the Chisso Corporation) mixed in water to form a coupling layer on the surfaces of the particles in the soft magnetic powder. By using different silane coupling agent concentrations in the contact step, the blending proportion for the silane coupling agent was adjusted to 0.1 mass % (Examples 2-1 and 2-3) and 0.05 mass % (Example 2-2), taking the magnetic core powder (sum of the soft magnetic powder, silicone resin, and silane coupling agent) to be 100 mass %.

Immediately after the contact step, the soft magnetic powder on which the coupling layer had been formed was mixed with the previously described silicone resin powder (powder production step). The amount of incorporation of the silicone resin powder at this time was 0.5 mass % with reference to the mixed powder as a whole (sum of the silicone resin and the soft magnetic powder on which the coupling layer had been formed). In this example, the temperature of the mixed powder during mixing in the powder production step was 130° C. in Examples 2-1 and 2-2 and 170° C. in Example 2-3.

Example 3

Powder magnetic cores were fabricated as in Example 2, but carrying out the drying step described below after the contact step.

The Drying Step

The soft magnetic powder that had been mixed with the aqueous silane coupling agent solution was dried for 5 minutes at 80° C.

After drying, the soft magnetic powder was mixed with the previously described silicone resin powder (powder production step). In this example, the temperature of the mixed powder during mixing was 130° C. in Examples 3-1 and 3-2 and 170° C. in Example 3-3.

Comparative Example 1

A powder magnetic core was fabricated as in Example 1, with the exception that the powder production step was carried out at room temperature.

Comparative Example 2

A powder magnetic core was fabricated as in Example 3-1, with the exception that the powder production step was carried out at room temperature.

Reference Example 1

Powder magnetic cores were fabricated by producing the magnetic core powder using the following procedure (wet method), and from the filling step onward following the procedure of Example 1.

A coating treatment solution was prepared by dissolving the previously described silicone resin powder in ethanol. This coating treatment solution was mixed with the soft magnetic powder after the soft magnetic powder had been subjected to the hydrogen reduction treatment; mixing was followed by evaporation of the solvent at 75 to 80° C. in a mantle oven. This was followed by ramping up the temperature to the prescribed temperature and holding for 10 minutes to provide a powder free of stickiness. The holding temperature after the temperature ramp-up was 130° C. in Reference Example 1-1 and 170° C. in Reference Example 1-2. The magnetic core powder obtained as a result had a silicone resin film formed on the surfaces of the soft magnetic powder particles; the silicone resin content was 0.5 mass % letting the magnetic core powder as a whole be 100 mass %.

Example 4

Powder magnetic cores were fabricated as in Example 1, but bringing the quantity of silicone resin powder incorporation to 1.0 mass % with reference to the mixed powder as a whole. The temperature of the mixed powder in the powder production step was 130° C. in Example 4-1, 150° C. in Example 4-2, and 170° C. in Example 4-3.

Example 5-1

A powder magnetic core was fabricated as in Example 2-1, but bringing the quantity of silicone resin powder incorporation to 1.0 mass % with reference to the mixed powder as a whole.

Example 6-1

A powder magnetic core was fabricated as in Example 3-1, but bringing the quantity of silicone resin powder incorporation to 1.0 mass % with reference to the mixed powder as a whole.

Comparative Example 3

A powder magnetic core was fabricated as in Comparative Example 1, but bringing the quantity of silicone resin powder incorporation to 1.0 mass % with reference to the mixed powder as a whole.

Comparative Example 4

A powder magnetic core was fabricated as in Comparative Example 2, but bringing the quantity of silicone resin powder incorporation to 1.0 mass % with reference to the mixed powder as a whole.

Reference Example 2-1

A powder magnetic core was fabricated as in Reference Example 1-1, but bringing the silicone resin content to 1.0 mass % with reference to the magnetic core powder as a whole.

Reference Example 2-2

A powder magnetic core was fabricated as in Reference Example 1-2, but bringing the silicone resin content to 1.0 mass % with reference to the magnetic core powder as a whole.

Example 7

Powder magnetic cores were fabricated as in Example 1, but bringing the quantity of silicone resin powder incorporation to 2.0 mass % with reference to the mixed powder as a whole. The temperature of the mixed powder in the powder production step was 130° C. in Example 7-1, 150° C. in Example 7-2, and 170° C. in Example 7-3.

Example 8-1

A powder magnetic core was fabricated as in Example 2-1, but bringing the quantity of silicone resin powder incorporation to 2.0 mass % with reference to the mixed powder as a whole.

Example 9-1

A powder magnetic core was fabricated as in Example 3-1, but bringing the quantity of silicone resin powder incorporation to 2.0 mass % with reference to the mixed powder as a whole.

Comparative Example 5

A powder magnetic core was fabricated as in Comparative Example 1, but bringing the quantity of silicone resin powder incorporation to 2.0 mass % with reference to the mixed powder as a whole.

Comparative Example 6

A powder magnetic core was fabricated as in Comparative Example 2, but bringing the quantity of silicone resin powder incorporation to 2.0 mass % with reference to the mixed powder as a whole.

Reference Example 3-1

A powder magnetic core was fabricated as in Reference Example 1-1, but bringing the silicone resin content to 2.0 mass % with reference to the magnetic core powder as a whole.

Reference Example 3-2

A powder magnetic core was fabricated as in Reference Example 1-2, but bringing the silicone resin content to 2.0 mass % with reference to the magnetic core powder as a whole.

Example 10

Powder magnetic cores were fabricated as in Example 1, but bringing the quantity of silicone resin powder incorporation to 0.2 mass % with reference to the mixed powder as a whole. The temperature of the mixed powder in the powder production step was 130° C. in Example 10-1 and 170° C. in Example 10-2.

Example 11-1

A powder magnetic core was fabricated as in Example 2-2, but bringing the quantity of silicone resin powder incorporation to 0.2 mass % with reference to the mixed powder as a whole.

Example 12-1

A powder magnetic core was fabricated as in Example 3-2, but bringing the quantity of silicone resin powder incorporation to 0.2 mass % with reference to the mixed powder as a whole.

Comparative Example 7

A powder magnetic core was fabricated as in Comparative Example 1, but bringing the quantity of silicone resin powder incorporation to 0.2 mass % with reference to the mixed powder as a whole.

Comparative Example 8

A powder magnetic core was fabricated as in Comparative Example 2, but bringing the quantity of silicone resin powder incorporation to 0.2 mass % with reference to the mixed powder as a whole.

Reference Example 4-1

A powder magnetic core was fabricated as in Reference Example 1-1, but bringing the silicone resin content to 0.2 mass % with reference to the magnetic core powder as a whole.

Reference Example 4-2

A powder magnetic core was fabricated as in Reference Example 1-2, but bringing the silicone resin content to 0.2 mass % with reference to the magnetic core powder as a whole.

[Evaluations]

Filling Behavior and Compacting Behavior

Figure 3:
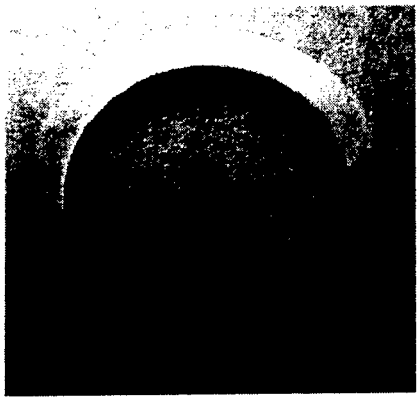
FIG. 3 is a photograph in lieu of a drawing, which shows a compact produced by a powder magnetic core production method according to an embodiment of the invention.
Figure 4:
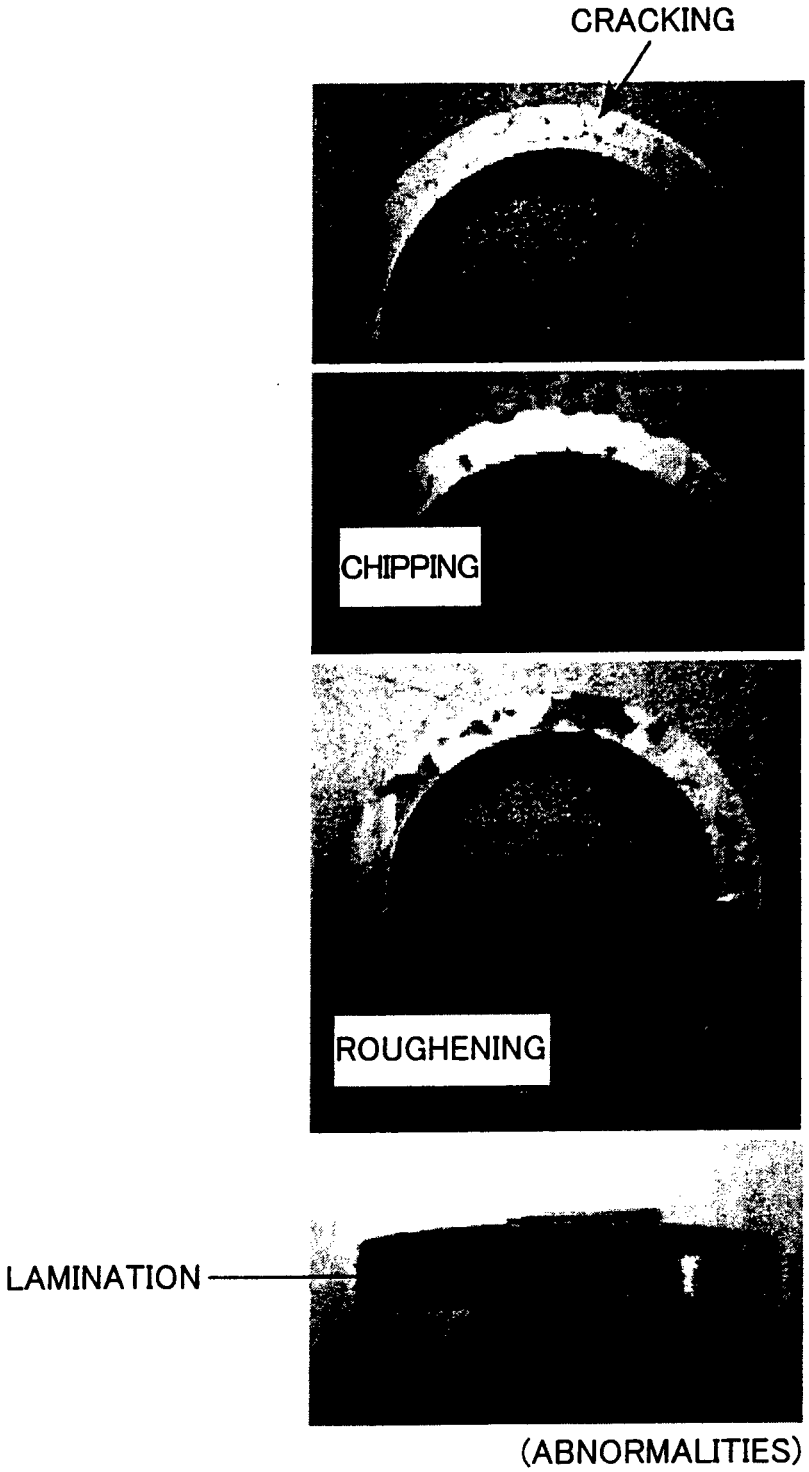
FIG. 4 is a photograph in lieu of a drawing, which shows compacts fabricated according to powder magnetic core production methods in the comparative examples.

The filling behavior in the filling step and the compacting behavior were evaluated. The results are shown in Tables 1 to 3. With regard to the filling behavior referenced in the tables, a score of ⓧ was rendered when the magnetic core powder could be smoothly filled into the cavity while maintaining its particle form unchanged; a score of ○ was rendered when the agglomeration of some of the magnetic core powder was observed; and a score of x was rendered when the magnetic core powder underwent agglomeration and the cavity could not be uniformly filled. With regard to the compacting behavior, a score of ⓧ was rendered when the surface of the compact was smooth and normal; a score of ○ was rendered when some abnormalities were observed on the surface, but not to a point that was problematic from a quality standpoint; and a score of x was rendered when abnormalities were observed over the entire surface. FIG. 3 shows the appearance of the compact provided by the production method of Example 1-1. FIG. 4 specifically shows each of the abnormalities observed with the compacts provided by the production methods in the comparative examples, i.e., cracking, chipping, roughness, and lamination.

TABLE 1

| | magnetic core powder production conditions | | | | | | | | | | |
|---|---|---|---|---|---|---|---|---|---|---|---|
| | dry method | | | | | | | | | | |
| | silane coupling layer formation step | | powder | wet method drying | | | | | | | |
| | | drying | production | temperature | evaluations | | | | | | |
| | contact step silane coupling agent (mass %) | step drying temperature (° C.) | step mixed powder heating temperature (° C.) | for the silicone resin-coated metal powder (° C.) | filling behavior | compacting behavior | powder magnetic core density (g/cm$^3$) | magnetic permeability | alternating current resistance (mΩ) | loss (kW/m$^3$) | radial crushing strength (MPa) |
| Example 1-1 | — | — | 130 | — | ⊗ | ⊗ | 7.27 | 201 | 427 | 445 | 37 |
| Example 1-2 | — | — | 150 | — | ⊗ | ⊗ | 7.09 | 126 | 353 | 475 | 23 |
| Example 1-3 | — | — | 170 | — | ⊗ | ⊗ | 7.10 | 120 | 324 | 468 | 22 |
| Example 2-1 | 0.1 | — | 130 | — | ⊗ | ⊗ | 7.20 | 153 | 350 | 470 | 18 |
| Example 2-2 | 0.05 | — | 130 | — | ⊗ | ⊗ | 7.35 | 180 | 423 | 440 | 37 |
| Example 2-3 | 0.1 | — | 170 | — | ⊗ | ⊗ | 6.91 | 138 | 323 | 547 | 18 |
| Example 3-1 | 0.1 | 80 | 130 | — | ○ | ⊗ | 7.18 | 157 | 345 | 484 | 63 |
| Example 3-2 | 0.05 | 80 | 130 | — | ○ | ⊗ | 7.16 | 157 | 383 | 486 | 63 |
| Example 3-3 | 0.1 | 80 | 170 | — | ○ | ⊗ | 7.19 | 183 | 411 | 470 | 56 |
| Comparative Example 1 | — | — | (room temperature) | — | X | X | 7.21 | 186 | 382 | 476 | 70 |
| Comparative Example 2 | 0.1 | 80 | (room temperature) | — | X | X | 7.22 | 182 | 366 | 485 | 65 |
| Reference Example 1-1 | — | — | — | 130 | ⊗ | ⊗ | 7.23 | 166 | 359 | 470 | 22 |
| Reference Example 1-2 | — | — | — | 170 | ⊗ | ⊗ | 7.23 | 125 | 329 | 480 | 20 |

Note:
The silicone resin incorporation rate is 0.5 mass % in all instances.

TABLE 2

| | magnetic core powder production conditions | | | | | | | | | | |
|---|---|---|---|---|---|---|---|---|---|---|---|
| | dry method | | | | | | | | | | |
| | silane coupling layer formation step | | powder | wet method drying | | | | | | | |
| | contact | drying step | production step | temperature for the | evaluations | | | | | | |
| | step silane coupling agent (mass %) | drying temperature (° C.) | mixed powder heating temperature (° C.) | silicone resin-coated metal powder (° C.) | filling behavior | compacting behavior | powder magnetic core density (g/cm$^3$) | magnetic permeability | alternating current resistance (mΩ) | loss (kW/m$^3$) | radial crushing strength (MPa) |
| Example 4-1 | — | — | 130 | — | ⊗ | ⊗ | 6.90 | 100 | 298 | 518 | 64 |
| Example 4-2 | — | — | 150 | — | ⊗ | ⊗ | 6.81 | 86 | 276 | 542 | 45 |
| Example 4-3 | — | — | 170 | — | ⊗ | ⊗ | 7.00 | 115 | 269 | 561 | 37 |
| Example 5-1 | 0.1 | — | 130 | — | ⊗ | ⊗ | 7.11 | 101 | 313 | 455 | 19 |
| Example 6-1 | 0.1 | 80 | 130 | — | ○ | ⊗ | 6.89 | 100 | 301 | 519 | 48 |
| Comparative Example 3 | — | — | (room temperature) | — | X | X | 7.08 | 124 | 334 | 477 | 71 |
| Comparative Example 4 | 0.1 | 80 | (room temperature) | — | X | X | 7.00 | 119 | 303 | 524 | 70 |
| Reference Example 2-1 | — | — | — | 130 | ⊗ | ⊗ | 7.04 | 102 | 288 | 563 | 26 |
| Reference Example 2-2 | — | — | — | 170 | ⊗ | ⊗ | 6.89 | 84 | 287 | 561 | 19 |
| Example 7-1 | — | — | 130 | — | ⊗ | ⊗ | 6.53 | 43 | 259 | 679 | 37 |
| Example 7-2 | — | — | 150 | — | ⊗ | ⊗ | 6.47 | 37 | 253 | 687 | 20 |
| Example 7-3 | — | — | 170 | — | ⊗ | ⊗ | 6.84 | 39 | 290 | 553 | 24 |

TABLE 2-continued

| | magnetic core powder production conditions | | | | | | | | | | |
|---|---|---|---|---|---|---|---|---|---|---|---|
| | dry method | | | | | | | | | | |
| | silane coupling layer formation step | | powder | wet method drying | | | | | | | |
| | contact | drying step | production step | temperature for the | evaluations | | | | | | |
| | step silane coupling agent (mass %) | drying tem-pera-ture (° C.) | mixed powder heating temperature (° C.) | silicone resin-coated metal powder (° C.) | filling behavior | compact-ing behavior | powder magnetic core density (g/cm$^3$) | magnetic permeability | alternating current resistance (mΩ) | loss (kW/m$^3$) | radial crushing strength (MPa) |
| Example 8-1 | 0.1 | — | 130 | — | ⊗ | ⊗ | 6.75 | 58 | 267 | 564 | 19 |
| Example 9-1 | 0.1 | 80 | 130 | — | ○ | ⊗ | 6.68 | 57 | 264 | 565 | 46 |
| Comparative Example 5 | — | — | (room temperature) | — | X | X | 6.49 | 45 | 279 | 530 | 47 |
| Comparative Example 6 | 0.1 | 80 | (room temperature) | — | X | X | 6.48 | 47 | 270 | 563 | 43 |
| Reference Example 3-1 | — | — | — | 130 | ⊗ | ⊗ | 6.51 | 38 | 259 | 685 | 28 |
| Reference Example 3-2 | — | — | — | 170 | ⊗ | ⊗ | 6.49 | 33 | 251 | 686 | 15 |

Note:
The silicone resin incorporation rate, considered in sequence from the top of the table, is 1.0 mass % in Example 4-1 to Reference Example 2-2 and 2.0 mass % in Example 7-1 to Reference Example 3-2.

TABLE 3

| | magnetic core powder production conditions | | | | | | | | | | |
|---|---|---|---|---|---|---|---|---|---|---|---|
| | dry method | | | | | | | | | | |
| | silane coupling layer formation step | | powder | wet method drying | | | | | | | |
| | contact | drying step | production step | temperature for the | evaluations | | | | | | |
| | step silane coupling agent (mass %) | drying tem-pera-ture (° C.) | mixed powder heating temperature (° C.) | silicone resin-coated metal powder (° C.) | filling behavior | compact-ing behavior | powder magnetic core density (g/cm$^3$) | magnetic permeability | alternating current resistance (mΩ) | loss (kW/m$^3$) | radial crushing strength (MPa) |
| Example 10-1 | — | — | 130 | — | ⊗ | ⊗ | 7.19 | 194 | 456 | 490 | 32 |
| Example 10-2 | — | — | 170 | — | ⊗ | ⊗ | 7.17 | 193 | 441 | 496 | 25 |
| Example 11-1 | 0.05 | — | 130 | — | ⊗ | ⊗ | 7.23 | 185 | 452 | 493 | 36 |
| Example 12-1 | 0.05 | 80 | 130 | — | ⊗ | ⊗ | 7.16 | 160 | 460 | 491 | 58 |
| Comparative Example 7 | — | — | (room temperature) | — | ⊗ | ⊗ | 7.16 | 229 | 496 | 487 | 32 |
| Comparative Example 8 | 0.1 | 80 | (room temperature) | — | ⊗ | ⊗ | 7.17 | 211 | 480 | 470 | 43 |
| Reference Example 4-1 | — | — | — | 130 | ⊗ | ⊗ | 7.18 | 195 | 456 | 476 | 25 |
| Reference Example 4-2 | — | — | — | 170 | ⊗ | ⊗ | 7.13 | 169 | 427 | 493 | 16 |

Note:
The silicone resin incorporation rate is 0.2 mass % in all instances.

Sample Measurements

The density, magnetic permeability, alternating current resistance, loss, and radial crushing strength were measured on the powder magnetic cores (ring-shaped test specimens) described above. The density of each test specimen, i.e., the bulk density of the powder magnetic core, was the calculated value determined from measurement of the dimensions and weight. The true density of the soft magnetic powder was 7.68 g/cm$^3$. The magnetic permeability was measured at 10 kHz and 10 mA using an Inductance Capacitance and Resistance (LCR) meter (model HiTester 35312, manufacturer: HIOKI E. E. Corporation). The alternating current resistance was measured by the 4-probe method using a digital multimeter (model R6581, manufacturer: ADC Corporation). The loss was measured at 0.2 T and 10 kHz using a magnetic flux density/magnetic field density (BH) analyzer (model SY-8232, manufacturer: IWATSU Test Instruments Corporation). The radial crushing strength was measured by the method specified in the Japanese Industrial Standards (JIS) as JISZ 2507. The results are given in Tables 1 to 3.

When the amount of resin present in the magnetic core powder was 0.2 mass %, it was shown that an excellent filling behavior and an excellent compacting behavior were obtained even using conventional production methods (Table 3). However, when the amount of resin present in the magnetic core powder was 0.5 mass % or more, the filling behavior and compacting behavior were impaired in the production methods of the comparative examples, which employed a conventional dry method.

In addition, when the amount of resin present in the magnetic core powder was 0.5 mass % or more, no problems appeared with regard to the filling behavior or compacting behavior in the case of the production methods in the reference examples, in which the magnetic core powder was produced using a wet method. Moreover, the radial crushing strength of the powder magnetic cores fabricated by the production methods in these reference examples (wet methods) was also as high as 28 MPa. However, with regard to the radial crushing strength of the powder magnetic cores fabricated by the production methods of the examples, even without the use of a silane coupling agent a high strength was produced that was the same as or greater than that of the powder magnetic cores fabricated by the production methods in the reference examples.

Among the examples in which a coupling layer was formed in the soft magnetic powder, higher strength occurred with the powder magnetic cores obtained by production methods in the examples that employed a drying step (Example 3, Example 6-1, and Example 9-1). Thus, it was shown that, when raising the strength of the powder magnetic core is an objective, a drying step accompanied by heating must be performed after the contact step. In addition, it was shown that a satisfactory wettability is obtained at a 0.05 mass % concentration for the silane coupling agent solution included in the magnetic core powder. Accordingly, taking the magnetic core powder to be 100 mass %, it was shown that the silane coupling agent is favorably adjusted to a content of about 0.03 to 0.08 mass %. While the filling behavior was lowered by the execution of the drying step, the extent of this was that the movement of the mixed powder in the cavity was somewhat impaired and obtaining a uniform surface was compromised; contamination of the cavity by melt bonding by the resin was not observed and this was not a matter of being unable to carry out compacting continuously. As a consequence, there was no negative influence on the compacting behavior.

Among the production methods in the examples, it was shown in Examples 1 to 3 (Table 1), Examples 4 to 6 and Examples 7 to 9 (Table 2), and Examples 10 to 12 (Table 3)—in which the mixed powder was heated in the powder production step—that a high strength was obtained for the powder magnetic core when 130° C. was used for the heating temperature for the mixed powder. Accordingly, it was shown that a high-strength powder magnetic core is obtained by making the heating temperature about 120 to 140° C. in the mixing of the mixed powder in the powder production step.

In the case of the reference examples, in which the silicone resin was coated on the particle surfaces in the soft magnetic powder by a wet method, the particle surfaces were considered to be more thoroughly insulatingly coated by the resin than in the comparative examples. This is readily derived from the fact that at least one value selected from the magnetic permeability, alternating current resistance, and loss of the powder magnetic cores obtained by the production methods in the reference examples is lower than that for the powder magnetic cores obtained by the production methods of the comparative examples. When specific comparisons are made for production methods that did not employ a silane coupling agent, in Table 1 the powder magnetic core obtained by the production method of Comparative Example 1 had higher values for the magnetic permeability, alternating current resistance, and loss than the powder magnetic core obtained by the production method of Reference Example 1-1. In addition, the powder magnetic core obtained by the production method of Comparative Example 1 had higher values for the magnetic permeability and alternating current resistance than the powder magnetic core obtained by the production method of Reference Example 1-2. The same also held true when the silicone resin incorporation rate was 0.2 mass %, 1.0 mass %, and 2.0 mass %. When one considers the three species of powder magnetic cores yielded by the production method in Example 1, which did not use a silane coupling agent, Examples 1-2 and 1-3 presented a low magnetic permeability, a low alternating current resistance, and a low loss that were at about the same levels as or lower levels than Reference Examples 1-1 and 1-2. Moreover, the powder magnetic core yielded by the production method of Example 1-1 had the lowest loss. The same trends were also observed when the silicone resin incorporation rate was 0.2 mass %, 1.0 mass %, or 2.0 mass %. Thus, the conclusion can be drawn that the particle surfaces were thoroughly insulatingly coated by the silicone resin in the magnetic core powders produced by the methods in the examples.

Accordingly, it was shown that the magnetic core powder produced by the production methods according to the embodiments of the invention and the powder magnetic core produced using this magnetic core powder exhibit, respectively, an excellent filling behavior and compacting behavior during powder magnetic core production and, through the favorable elaboration of an insulating coating by the resin, magnetic properties and strength about the same as or superior to those of a powder magnetic core that uses a magnetic core powder produced by a wet method.

In the embodiments of the invention, the "hot state" may be a state occurring under an elevated temperature environment present in the temperature region in which the resin powder undergoes softening, that is, the temperature region in which the resin powder as a whole does not undergo complete condensation polymerization and the viscosity exhibits a declining trend as the temperature rises.

The resin film may be formed in the embodiments of the invention on each one of the particles in the magnetic core powder or may be formed over the circumference of a plurality of magnetic core powder particles that have become fixed to one another. In each case the magnetic core powder in which the resin film has been formed exhibits an excellent filling behavior and compacting behavior. In the powder filling step in particular, and, for example, in those instances in which the die is preheated to around the compacting temperature in the ensuing compacting step, the resin powder is quite susceptible to the effects of the heat from the die when the resin powder is filled into the die. The thermosetting resin present in the magnetic core powder yielded by the powder production step exhibits an excellent filling behavior because it has been cooled after a temporary softening. In addition, the appearance (compacting behavior) of the compact and the powder magnetic core are also excellent. This is thought to be due to the following: the re-solidified solid resin, obtained by cooling the softened solid thermosetting resin, is less likely to become sticky by the heat of the preheated die than the n heated solid resin. As a result, the magnetic core powder is resistant during filling to the influence of preheating and filling can frequently be carried out as smoothly as for the filling of the resin powder into the ambient temperature die. Thus, the magnetic core powder that has passed through the powder production step, even when introduced into a preheated cavity, resists the appearance of stickiness, resists particle agglomeration, and resists melt bonding by the thermosetting resin to the cavity and thus exhibits an excellent filling behavior. In addition, after filling into the cavity, the magnetic core powder exhibits an improved compacting behavior due to its uniform dissemination into the cavity.

The form of the powder magnetic core in the embodiments of the invention may be a bulk form or may be the form of a material as provided by, for example, suitable mechanical milling, or may be a final shape or the form of a structural member that itself approximates the final shape.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

The invention claimed is:

1. A method of producing a powder magnetic core, comprising:

obtaining a magnetic core powder by mixing magnetic powder with a thermosetting resin powder in hot state at temperature that brings a viscosity of the thermosetting resin powder to less than or equal to $10^4$ Pa-s such that a resin film is formed on particle surfaces of the magnetic core powder, the temperature being equal to or higher than a compacting temperature and being less than an initial hardening temperature of the thermosetting resin powder;

cooling the obtained magnetic core powder;

filling the cooled magnetic core powder into a preheated die;

compacting the filled magnetic core powder at the compacting temperature to obtain a compact; and heating the obtained compact into a state in which the thermosetting resin powder hardens.

2. The method of producing the powder magnetic core according to claim 1, wherein the mixing, the magnetic powder with the thermosetting resin powder includes mixing the magnetic powder with the thermosetting resin powder at a temperature that is at least 10° C. higher than an initial softening temperature of the thermosetting resin powder and not more than 130° C. higher than the initial softening temperature of the thermosetting resin powder.

3. The method of producing the powder magnetic core according to claim 1, wherein a blending proportion for the thermosetting resin powder, when mixing the magnetic powder with resin powder in the hot state, is more than 0.1 mass % and not more than 3 mass % in where a total magnetic core powder is defined as 100 mass %.

4. The method of producing the powder magnetic core according to claim 1, wherein the thermosetting resin powder is made of a thermosetting silicone resin.

5. The method of producing the powder magnetic core according to claim 1, further comprising:

bringing the surface of the magnetic powder into contact with silane coupling agents; and drying the magnetic powder whose surface has been brought into contact with the silane coupling agent.

* * * * *